US007615942B2

(12) United States Patent
Sanders et al.

(10) Patent No.: US 7,615,942 B2
(45) Date of Patent: Nov. 10, 2009

(54) CAST DIELECTRIC COMPOSITE LINEAR ACCELERATOR

(75) Inventors: David M. Sanders, Livermore, CA (US); Stephen Sampayan, Manteca, CA (US); Kirk Slenes, Albuquerque, NM (US); H. M. Stoller, Albuquerque, NM (US)

(73) Assignees: Lawrence Livermore National Security, LLC, Livermore, CA (US); TPL, Inc., Albuquerque, MN (US)

( * ) Notice: Subject to any disclaimer, the term of this patent is extended or adjusted under 35 U.S.C. 154(b) by 513 days.

(21) Appl. No.: 11/599,797

(22) Filed: Nov. 14, 2006

(65) Prior Publication Data

US 2007/0138980 A1 Jun. 21, 2007

Related U.S. Application Data

(60) Provisional application No. 60/737,028, filed on Nov. 14, 2005.

(51) Int. Cl.
*H05H 9/00* (2006.01)

(52) U.S. Cl. ..... 315/505; 315/500; 156/288

(58) Field of Classification Search ..... 315/5.41, 315/5.42, 505, 500, 507, 506, 111.61, 111.81; 313/359.1; 156/288
See application file for complete search history.

(56) References Cited

U.S. PATENT DOCUMENTS 5,742,471 A 4/1998 Barbee, Jr. et al.
5,811,944 A 9/1998 Sampayan et al.
5,821,705 A 10/1998 Caporaso et al.
6,608,760 B2 8/2003 Hartman et al.
6,616,794 B2 9/2003 Hartman et al.
6,621,687 B2 9/2003 Lewis, Jr. et al.
2007/0013315 A1 * 1/2007 Rhodes ..... 315/39

OTHER PUBLICATIONS

Sampayan S et al: "Development of a Compact Radiography Accelerator Using Dielectric Wall Accelerator Technology", Pulsed Power Conference, 2005 IEEE, IEEE, PI, Jun. 2005.
(Jun. 2005), pp. 50-53, XP031014888 ISBN: 0-7803-9189-6, abstract; figures 1,2, p. 52, col. 1, line 6—col. 2, line 17.

Matthew T Domonkos et al: "A Ceramic Loaded Polymer Blumlein Pulser for Compact, Rep-Rated Pulsed Power Applications" Pulsed Power Conference, 2005 IEEE, IEEE, PI, Jun. 2005.
(Jun. 2005), pp. 1322-1325, XP031015208, ISBN: 0-7803-9189-6, abstract; figure 5, p. 1323, lines 25-39.

* cited by examiner

*Primary Examiner*—Douglas W Owens
*Assistant Examiner*—Ephrem Alemu
(74) *Attorney, Agent, or Firm*—James S. Tak; John H. Lee

(57) ABSTRACT

A linear accelerator having cast dielectric composite layers integrally formed with conductor electrodes in a solventless fabrication process, with the cast dielectric composite preferably having a nanoparticle filler in an organic polymer such as a thermosetting resin. By incorporating this cast dielectric composite the dielectric constant of critical insulating layers of the transmission lines of the accelerator are increased while simultaneously maintaining high dielectric strengths for the accelerator.

21 Claims, 4 Drawing Sheets

CAST DIELECTRIC COMPOSITE LINEAR ACCELERATOR

I. REFERENCE TO PRIOR APPLICATIONS

This application claims the benefit of U.S. Provisional Application No. 60/737,028, filed Nov. 14, 2005 incorporated by reference herein.

The United States Government has rights in this invention pursuant to Contract No. W-7405-ENG-48 between the United States Department of Energy and the University of California for the operation of Lawrence Livermore National Laboratory.

II. FIELD OF THE INVENTION

The present invention relates to linear accelerators and more particularly to a linear accelerator having a dielectric composite that is cast to fill the space between conductor electrodes in an accelerator transmission line, with the cast dielectric composite having a high dielectric constant enabling high voltage pulse gradients to be generated along a particle acceleration axis.

III. BACKGROUND OF THE INVENTION

Particle accelerators are used to increase the energy of electrically-charged atomic particles, e.g., electrons, protons, or charged atomic nuclei, so that they can be studied by nuclear and particle physicists. High energy electrically-charged atomic particles are accelerated to collide with target atoms, and the resulting products are observed with a detector. At very high energies the charged particles can break up the nuclei of the target atoms and interact with other particles. Transformations are produced that tip off the nature and behavior of fundamental units of matter. Particle accelerators are also important tools in the effort to develop nuclear fusion devices, as well as for medical applications such as cancer therapy.

There is a need for improved linear accelerator architectures and constructions which produce the high voltage pulse gradients in a compact structure to enable the generation, acceleration, and control of accelerated particles in a compact unit. In particular, it is highly desirable to incorporate high dielectic constant materials that enable propagation of electrical wavefronts in compact Blumlein-based linear accelerators to generate the high voltage pulse gradients.

IV. SUMMARY OF THE INVENTION

One aspect of the present invention includes a compact linear accelerator comprising: at least one transmission line (s) extending towards a transverse acceleration axis from a first end to a second end for propagating an electrical wavefront(s) therethrough to impress a pulsed gradient along the acceleration axis, each transmission line comprising: a first conductor having first and second ends with the second end adjacent the acceleration axis; a second conductor adjacent the first conductor and having first and second ends with the second end adjacent the acceleration axis; and a cast dielectric composite that fills the space between the first and second conductors and comprising at least one organic polymer and at least one particle filler having a dielectric constant greater than that of the organic polymer.

Another aspect of the present invention includes a method of fabricating a linear accelerator, comprising: casting at least one dielectric composite slab(s) comprising at least one organic polymer and at least one particle filler having a dielectric constant greater than that of the organic polymer; coating the cast dielectric composite slab(s) with a second dielectric composite material having a dielectric constant greater than that of the cast dielectric slab(s); and pressing two conductors against each second dielectric composite material-coated cast dielectric composite slab to extrude the second dielectric composite material out from therebetween to completely fill the triple point region with the second dielectric composite material.

And another aspect of the present invention includes a method of fabricating a linear accelerator, comprising: positioning at least one conductor(s) in a mold cavity; filling the mold cavity with a dielectric composite comprising at least one organic polymer(s) and at least one particle filler(s) space having a dielectric constant greater than that of the organic polymer(s), to at least partially immerse the conductor(s) in the composite; and curing the dielectric composite to integrally cast the dielectric composite with the conductor(s).

V. BRIEF DESCRIPTION OF THE DRAWINGS

The accompanying drawings, which are incorporated into and form a part of the disclosure, are as follows.

VI. DETAILED DESCRIPTION

Figure 1:
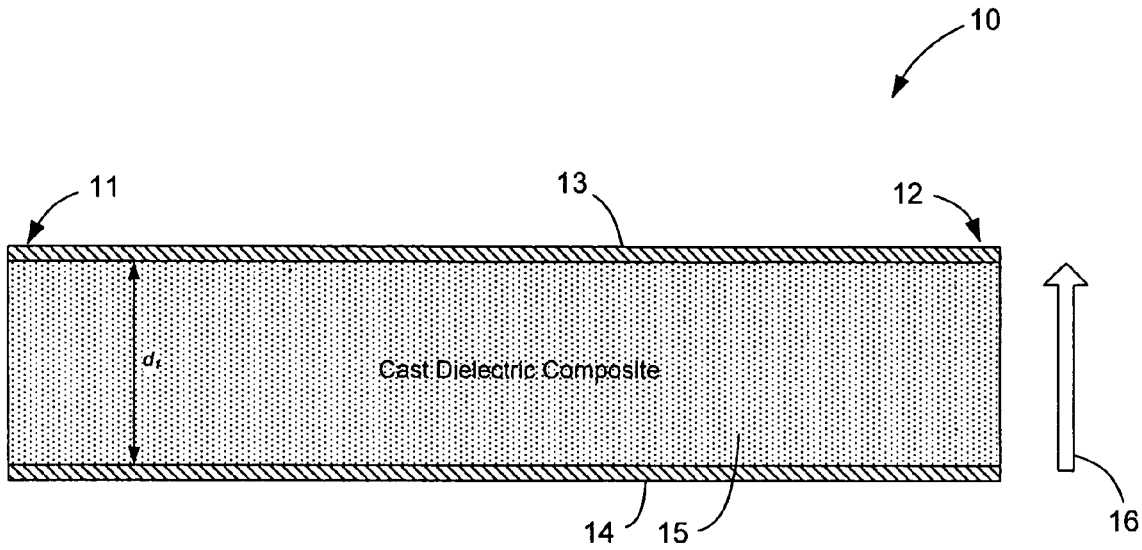
FIG. 1 is a side cross-sectional view of a single transmission line of a linear accelerator of the present invention.
Figure 2:
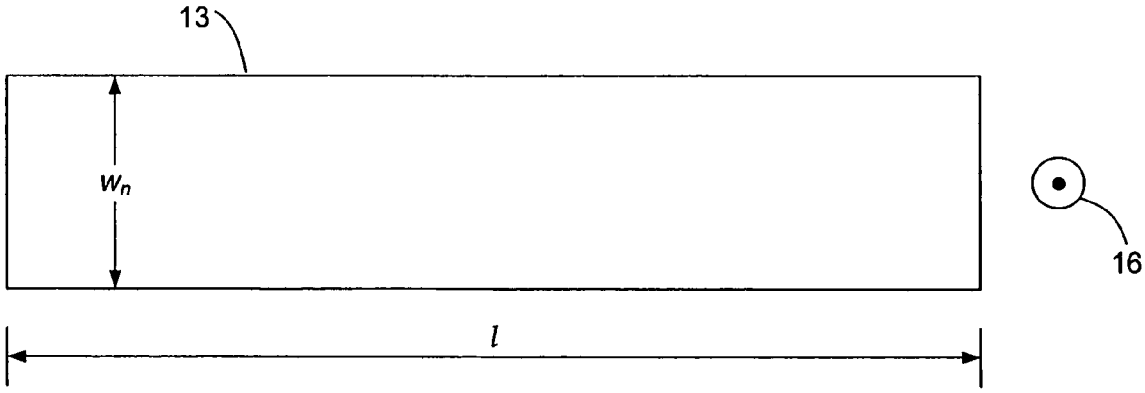
FIG. 2 is a top view of the transmission line of FIG. 1.

Turning now to the drawings, FIGS. 1-2 show an exemplary transmission line of the linear accelerator of the present invention, generally indicated at reference character 10 which generally comprises at least one such transmission line(s). The transmission line structure includes a first conductor 13, a second conductor 14 adjacent the first conductor, and a dielectric composite material 15 that fills the space between the conductors and that is cast fabricated in a manner described herein.

As shown, the transmission line 10 preferably has a parallel-plate strip configuration, i.e. a long narrow geometry, typically of uniform width but not necessarily so. The particular transmission line shown in FIGS. 1 and 2 has an elongated beam or plank-like linear configuration extending between a first end 11 and a second end 12, and having a relatively narrow width, $w_n$ compared to the length, l. This strip-shaped configuration of the transmission line operates to guide a propagating electrical signal wave from the first end 11 to the second end 12, and thereby control the output pulse at the second end. In particular, the shape of the wavefront may be controlled by suitably configuring the width of the module, e.g. by tapering the width (not shown). The strip-shaped configuration enables the compact accelerator to produce a flat output (voltage) pulse without distorting the pulse, and thereby prevent a particle beam from receiving a time varying energy gain. As used herein and in the claims, the first end 11 is characterized as that end which is connected to a switch (e.g. 28 in FIG. 3), and the second end 12 is that end adjacent a load region, such as an output pulse region adjacent an acceleration axis 16, for particle acceleration.

Figure 3:
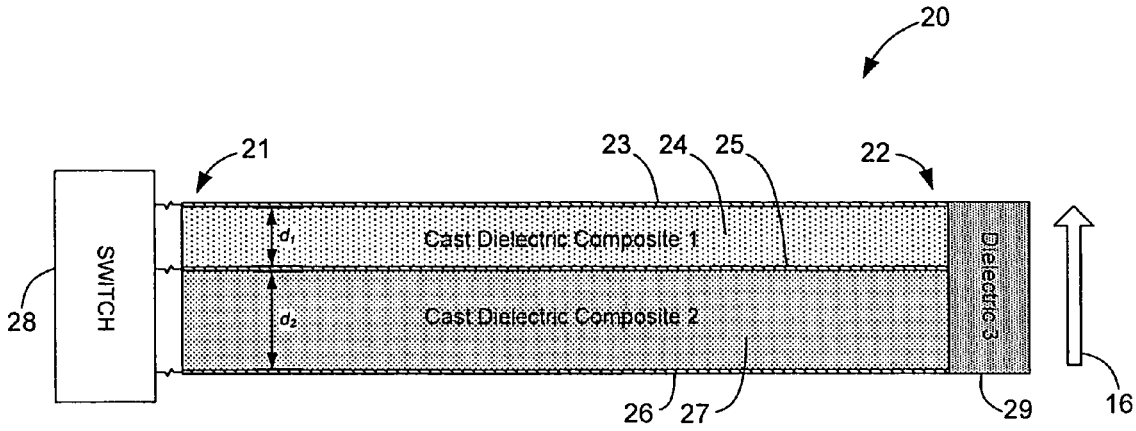
FIG. 3 is a side cross-sectional view of a first illustrative embodiment of a single asymmetric Blumlein module of the linear accelerator of the present invention, with first and second cast dielectric composite layers having different dielectric constants and thicknesses.
Figure 4:
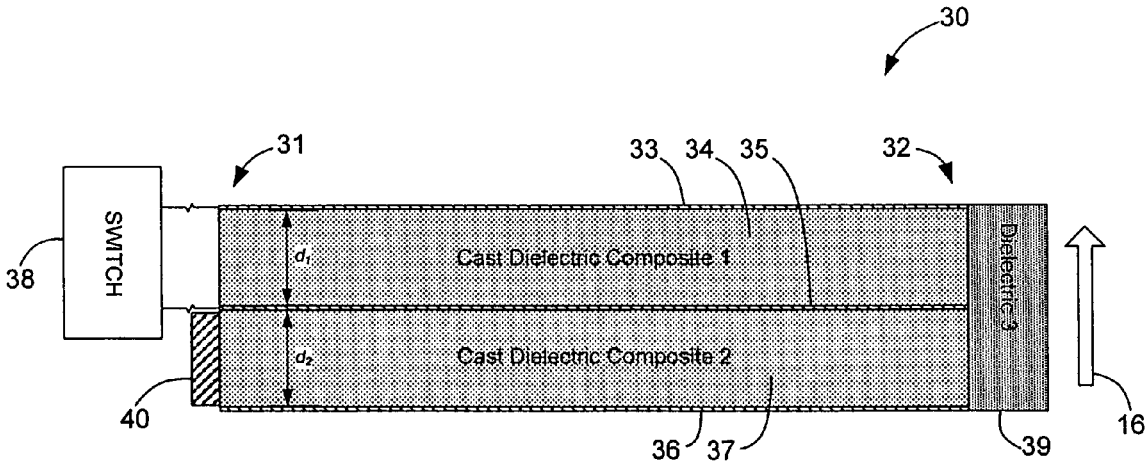
FIG. 4 is a side cross-sectional view of a second illustrative embodiment of a single symmetric Blumlein module of the present invention, with first cast and second cast dielectric composites having the same dielectric constants and the same thicknesses.

FIGS. 3 and 4 show two exemplary embodiments of the cast dielectric composite linear accelerator of the present invention for asymmetric Blumlein operation and symmetric Blumlein operation. A typical Blumlein module has two transmission lines comprising first, second, and third conductors, with a first dielectric that fills the space between the first and second conductors, and a second dielectric that fills the space between the second and third conductors. While not shown in FIGS. 3 and 4, it is appreciated that the linear accelerator also includes a high voltage power supply connected to charge the second conductor strip to a high potential, and a switch (e.g. 28 in FIG. 3) for switching the high potential in the second conductor strip to at least one of the first and third conductor strips so as to initiate a propagating reverse polarity wavefront(s) in the corresponding dielectric layer(s).

FIG. 3 in particular shows a first exemplary embodiment of the compact linear accelerator, generally indicated at reference character 20, and comprising a single asymmetric Blumlein module (i.e. two transmission lines) connected to a switch 28. As shown in FIG. 3 the narrow beam-like structure of a preferred asymmetric Blumlein module includes three planar conductors shaped into thin strips and separated by dielectric composite material also shown as elongated but thicker strips. In particular, a first planar conductor strip 23 and a middle second planar conductor strip 25 are separated by a first dielectric material 24 which fills the space therebetween. And the second planar conductor strip 25 and a third planar conductor strip 26 are separated by a second dielectric material 27 which fills the space therebetween. Preferably, the separation produced by the dielectric materials positions the planar conductor strips 23, 25 and 26 to be parallel with each other as shown.

An optional third dielectric material 29 is also shown connected to and capping the planar conductor strips and dielectric composite strips 23-27. As such the third dielectric material 29 is a dielectric sleeve or wall characteristic of this type of accelerator, known in the art as a "dielectric wall accelerator" or "DWA". This third dielectric material 29 serves to combine the waves and allow only a pulsed voltage to be across the vacuum wall, thus reducing the time the stress is applied to that wall and enabling even higher gradients. It can also be used as a region to transform the wave, i.e., step up the voltage, change the impedance, etc. prior to applying it to the accelerator. As such, the third dielectric material 29 and the second end 22 generally, are shown adjacent a load region indicated by arrow 16. In particular, arrow 16 represents an acceleration axis of a particle accelerator and pointing in the direction of particle acceleration. It is appreciated that the direction of acceleration is dependent on the paths of the fast and slow transmission lines, through the two dielectric strips.

In FIG. 3, the switch 28 is shown connected to the planar conductor strips 23, 25, and 26 at the respective first ends, i.e. at first end 21 of the Blumlein module. The switch serves to initially connect the outer planar conductor strips 23, 26 to a ground potential and the middle conductor strip 25 to a high voltage source (not shown). The switch 28 is then operated to apply a short circuit at the first end so as to initiate a propagating voltage wavefront through the Blumlein module and produce an output pulse at the second end. In particular, the switch 28 can initiate a propagating reverse polarity wavefront in at least one of the dielectrics from the first end to the second end, depending on whether the Blumlein module is configured for symmetric or asymmetric operation.

When configured for asymmetric operation, as shown in FIG. 3, the Blumlein module comprises different dielectric constants and thicknesses ($d_1 \neq d_2$) for the dielectric composite layers 24, 27. The asymmetric operation of the Blumlein generates different propagating wave velocities through the dielectric layers. And preferably, the second dielectric composite strip 27 has a substantially lesser propagation velocity than the first dielectric strip 24, such as for example 3:1, where the propagation velocities are defined by $v_2$, and $v_1$, respectively, where $v_2=(\mu_2 \in_2)^{-0.5}$ and $v_1=(\mu_1 \in_1)^{-0.5}$; the permeability, $\mu_1$, and the permittivity, $\in_1$, are the material constants of the first dielectric material; and the permeability, $\mu_2$, and the permittivity, $\in_2$, are the material constants of the second dielectric material. This can be achieved by selecting for the second dielectric strip a material having a dielectric constant, i.e. $\mu_1 \in_1$, which is greater than the dielectric constant of the first dielectric strip, i.e. $\mu_2 \in_2$. As shown in FIG. 3, for example, the thickness of the first dielectric strip is indicated as $d_1$, and the thickness of the second dielectric strip is indicated as $d_2$, with $d_2$ shown as being greater than $d_1$. By setting $d_2$ greater than $d_1$, the combination of different spacing and the different dielectric constants results in the same characteristic impedance, Z, on both sides of the second planar conductor strip 25. It is notable that although the characteristic impedance may be the same on both halves, the propagation velocity of signals through each half is not necessarily the same.

FIG. 4 shows a symmetric Blumlein configuration of the linear accelerator generally indicated at reference character 30, and having a first conductor 34, second conductor 35 and third conductor 36 in alternating layered arrangement with first and second cast dielectric composites 34, 37. However, when the Blumlein module is configured for symmetric operation, the dielectric composite strips 34, 35 are of the same dielectric constant, and the width and thickness ($d_1=d_2$) are also the same. In addition, as shown in FIG. 4, a magnetic material 40 is also placed in close proximity to the second dielectric composite strip 37 such that propagation of the wavefront is inhibited in that strip. In this manner, the switch is adapted to initiate a propagating reverse polarity wavefront in only the first dielectric composite strip 34.

It is appreciated that the switches 28 and 38 are suitable switches for asymmetric or symmetric Blumlein module operation, such as for example, gas discharge closing switches, surface flashover closing switches, solid state switches, photoconductive switches, etc. And it is further appreciated that the choice of switch and dielectric material types/dimensions can be suitably chosen to enable the compact accelerator to operate at various acceleration gradients, including for example gradients in excess of twenty megavolts per meter. However, lower gradients would also be achievable as a matter of design. It is also appreciated that the Blumlein modules fabricated using the dielectric composite materials of this invention can be stacked to form a single acceleration cell, i.e. comprising at least one additional Blumlein module stacked in alignment with the first Blumlein module. The layers of the stack may have different dielectric constants and different thicknesses.

Generally, the cast dielectric composite material used for the layer 15 in FIG. 1, layers 24 and 27 in FIG. 3, and layers 34 and 37 in FIG. 4 is of a type generally described in U.S. Pat. No. 6,608,760, incorporated herein by reference, but fabricated using a casting process to produce a high dielectric constant, preferably from 2 to 40, for high energy particle acceleration, and not by roll forming. As such, the cast dielectric composite comprises at least one organic polymer and at least one particle filler which are cast together in a composite matrix. The particle filler has a dielectric constant greater than the organic polymer. And preferably, the at least one organic polymer has a $T_g$ greater than 140° C. and the cast dielectric composite has a dielectric constant that varies less than 15% over a temperature range of from −55 to 125 C. Casting such dielectric composite enable the transmission line(s) of the present invention to have an extremely high breakdown voltage that exceeds 100 kV/cm.

Preferably the particle fillers are non-refractory ferroelectric particles having a cubic crystalline structure, which exhibit a high and vary stable dielectric constant over wide ranging temperatures. The term "non-refractory ferroelectric particles" is used herein to refer to particles made from one or more ferroelectric materials. Preferred ferroelectric materials include barium titanate, strontium titanate, barium neodymium titanate, barium strontium titanate, magnesium zirconate, titanium dioxide, calcium titanate, barium magnesium titanate, lead zirconium titanium and mixtures thereof.

Furthermore, the ferroelectric particles useful in the present invention may have particle size ranging from about 20 to about 150 nanometers. It is preferred that the particles are essentially all nanoparticles which means that the particles have a particle size of less than 100 nanometers and preferably a particle size of about 50 nanometers. It Is also preferred that at least 50% of the ferroelectric particles have a size ranging from 50 to 100 nanometers and preferably from 40-60 nanometers. The ferroelectric particles useful in this invention are preferably manufactured by a non-refractory process such as a precipitation process, such as for example 50 nanometer barium or strontium titanate nanoparticles manufactured by TPL, Inc.

The ferroelectric particles are combined with at least one polymer to form dielectric layers. The ferroelectric particles may be present in the dielectric layer in an amount preferably ranging from about 10 to about 80 weight % or preferably from about 15 to 50 vol % and most preferably from about 20 to 40 vol % of the dielectric layer with the remainder of the dielectric layer comprising one or more resin systems. The ferroelectric particles are preferably combined with one or more resins that are commonly used to manufacture dielectric printed circuit board layers. The resins may include material such as silicone resins, cyanate ester resins, epoxy resins, polyamide resins, Kapton material, bismaleimide triazine resins, urethane resins, mixtures of resins and any other resins that are useful in manufacturing dielectric substrate materials. The resin is preferably a high $T_g$ resin. By high $T_g$, it is meant that the resin system used should have a cured $T_g$ greater than about 140° C. It is more preferred that the resin $T_g$ be in excess of 160° C. and most preferably in excess of 180° C. A preferred resin system is 406-N Resin manufactured by Allied-Signal Inc.

While the dielectric composite material used in the present invention is substantially the same as that disclosed in U.S. Pat. No. 6,608,760, the method of fabrication in the present invention utilizes a casting method to produce slab layers of cast dielectric composite for use in a linear accelerator.

Figure 5:
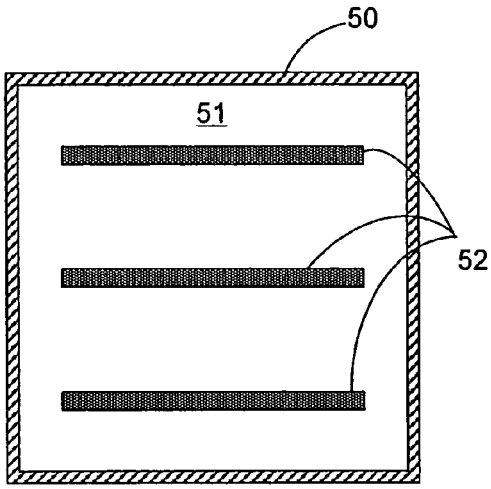
FIG. 5 is a top view of a mold form with conductors positioned therein in a first exemplary accelerator fabrication method of the present invention.
Figure 6:
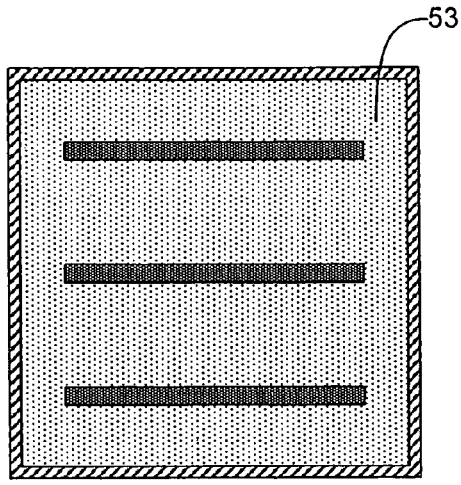
FIG. 6 is a top view following FIG. 5 after introducing the dielectric composite material into the mold cavity of the mold form.
Figure 7:
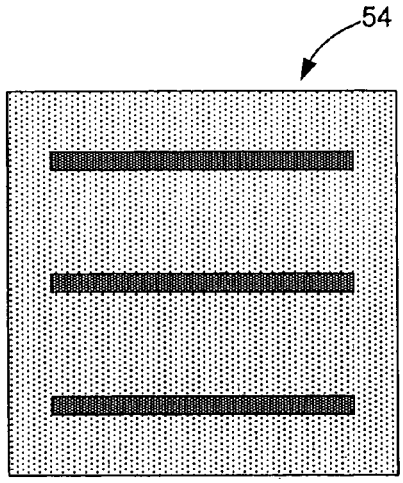
FIG. 7 is a top view following FIG. 6 after removing the integrally cast dielectric composite and conductors from the mold form.

In FIGS. 5-7, a first exemplary method of fabricating the linear accelerator is shown. A mold form 50 is provided having a mold cavity 51, in which conductors, such as conductor slabs/strips 52 are spacedly arranged. In FIG. 6, the yet un-cured and fluid dielectric composite slurry is poured or otherwise introduced into the mold cavity to at least partially immerse the conductors. The dielectric composite is then cured at appropriate temperatures and pressures. The curing temperatures and pressures can range, for example, from about 50 to about 150° C. and the pressures can vary from about 100 to about 1500 psi. After curing, as shown in FIG. 7, a cast monolithic body 54 is produced substantially in the shape of the mold cavity, with the cast dielectric composite surrounding the conductor electrodes to minimize electrical fields at the edges.

Figure 11:
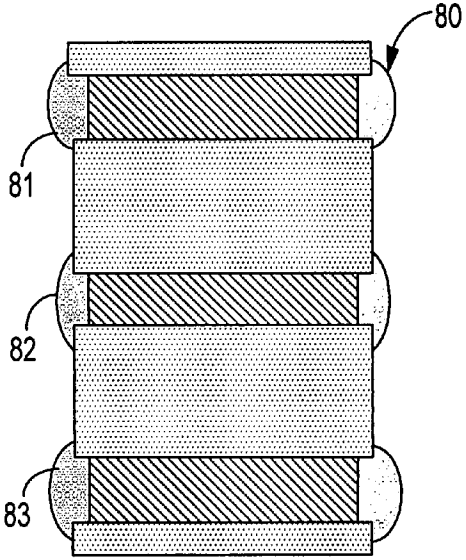
FIG. 11 is a side view following FIG. 10 showing the final form or a linear accelerator having the second dielectric extruded to fill the region of the triple point.
Figure 10:
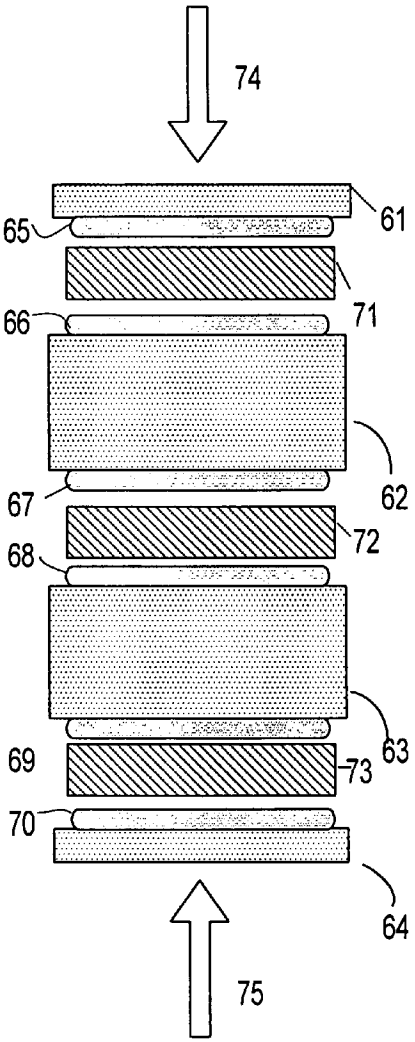
FIG. 10 is a side view following FIG. 9, of two cast dielectric composite layers coated with a second dielectric material and positioned in alternative arrangement with conductor electrodes to be pressed into a multilayer.
Figure 8:
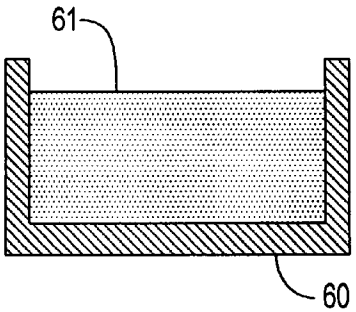
FIG. 8 is a side view of a mold form with dielectric composite material therein in a second exemplary accelerator fabrication method of the present invention.
Figure 9:
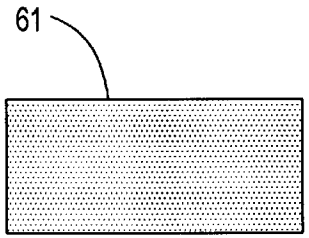
FIG. 9 is a side view following FIG. 8 of a cast dielectric composite produce from the mold form.

FIGS. 8-11 show a second exemplary method of fabricating the linear accelerator of the present invention. In FIG. 8, a mold form 60 is provided in which the dielectric composite slurry 61 is poured or otherwise introduced, from which the dielectric composite slab 61 in FIG. 9 is cast to take the shape of the mold form. In FIG. 10, the cast dielectric composite 61 is shown layered with an additional cast dielectric composite (reference numerals 62, 63, and 64) in alternating arrangement with conductor electrodes 71, 72, and 73. However prior to combining the layers, FIG. 10 also shows a second material (reference numerals 65, 66, 67, 68, and 69) with a higher dielectric constant coated over the contact surfaces of the dielectric slabs. The second dielectric material is preferably also a dielectric composite of a type discussed herein, but with a higher concentration of high dielectric constant nanoparticles. The conductors 71, 72, and 73 are then pressed against the second dielectric-coated dielectric slabs 61, 62, 63, and 64, as indicated by arrows 74 and 75, such that the second dielectric material is extruded out from between the conductors and dielectric composite slabs. Preferably the conductive electrodes are coated with one of conducting, semi-conducting, insulating, or semi-insulating layers. FIG. 11 shows a final form 80 of the linear accelerator fabricated in this manner, with the second dielectric material 81-83 filling the triple point regions at the separation of the conductor and the dielectric composite slab. In this manner, electric fields may be diminished at the edges to improve performance.

The dielectric layer may include an optional second filler material in order to impart strength to the dielectric layer. Examples of the second filler materials include woven or non-woven materials such as quartz, silica glass, electronic grade glass and ceramic and polymers such as aramids, liquid crystal polymers, aromatic polyamides, or polyesters, particulate materials such as ceramic polymers, and other fillers and reinforcing material that are commonly used to manufacture printed wiring board substrate. The optional second filler material my be present in the dielectric layer in an amount ranging from about 20 to 70 wt % and preferably from an amount ranging from about 35 to about 65 wt %.

The dielectric materials of this invention may include other optional ingredients that are commonly used in the manufacture of dielectric layers. For example, the dielectric particles and/or the second filler material can include a binding agent to include the bond between the filler and the resin material in order to strengthen the dielectric layer. In addition, the resin compositions useful in this invention may include coupling agents such as silane coupling agents, zirconates and titanates. In addition, the resin composition useful in this invention may include surfactants and wetting agents to control particle agglomeration or coated surface appearance. The dielectric layers manufactured using the resin/ferroelectric particle of this invention will preferably have a thickness greater than 0.005 inch.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

We claim:

1. A compact linear accelerator comprising:

at least one transmission line extending towards a transverse acceleration axis from a first end to a second end for propagating an electrical wavefront therethrough to impress a pulsed gradient along the acceleration axis, each transmission line comprising: a first conductor having first and second ends with the second end adjacent the acceleration axis; a second conductor adjacent the first conductor and having first and second ends with the second end adjacent the acceleration axis; and a cast dielectric composite that fills the space between the first and second conductors and comprising at least one organic polymer and at least one particle filler having a dielectric constant greater than that of the organic polymer.

2. The compact linear accelerator of claim 1, wherein the first and second conductors and the cast dielectric composite have parallel-plate strip configurations extending longitudinally from the first to second ends.

3. The compact linear accelerator of claim 1, wherein two transmission lines extend toward the transverse acceleration axis to form a Blumlein module comprising the first conductor, the second conductor, the dielectric composite therebetween, a third conductor adjacent the second conductor and having a first end and a second end adjacent the acceleration axis, and a second dielectric composite that fills the space between the second and third conductors and comprising at least one organic polymer and at least one particle filler having a dielectric constant greater than that of the organic polymer.

4. The compact linear accelerator of claim 3, wherein the first and second dielectric composites have different dielectric constants to form an asymmetric Blumlein.

5. The compact linear accelerator of claim 3, wherein the first and second dielectric composites have the same dielectric constants to form a symmetric Blumlein.

6. The compact linear accelerator of claim 3, further comprising at least one additional Blumlein module stacked in alignment with the first Blumlein module.

7. The compact linear accelerator of claim 1, wherein the first and second conductors are coated with a material chosen from the group consisting of conductive, semi-conductive, semi-insulating, and insulating layers.

8. The compact linear accelerator of claim 1, wherein the cast dielectric composite has a thickness greater than 0.005 inch.

9. The compact linear accelerator of claim 1, wherein the cast dielectric composite has a dielectric constant from 2 to 40.

10. The compact linear accelerator of claim 1, wherein the cast dielectric composite has a dielectric constant that varies less than 15% when the composite is subjected to a temperature of from −55 to 125° C.

11. The compact linear accelerator of claim 1, wherein the cast dielectric composite has a breakdown voltage greater than 100 kV/cm.

12. The compact linear accelerator of claim 1, wherein the at least one particle filler has a particle size substantially in the range between approximately 20 and 150 nanometers.

13. The compact linear accelerator of claim 12, wherein the at least one particle filler comprises non-refractory ferroelectric particles having a cubic crystalline structure.

14. The compact linear accelerator of claim 13, wherein the composite includes from about 10 to about 80 percent by weight ferroelectric particles.

15. The compact linear accelerator of claim 13, wherein the ferroelectric particles are barium-based ceramic particles.

16. The compact linear accelerator of claim 13, wherein the ferroelectric particles are selected from the group consisting of barium titanate, strontium titanate, and mixtures thereof.

17. A method of fabricating a linear accelerator transmission line which extends towards a transverse acceleration axis from a first end to a second end for propagating an electrical wavefront therethrough to impress a pulsed gradient along the acceleration axis, comprising:

casting at least one dielectric composite slab to have first and second ends which correspond to the first and second ends respectively of the transmission line, and comprising at least one organic polymer and at least one particle filler having a dielectric constant greater than that of the organic polymer;

coating the cast dielectric composite slab with a second dielectric composite material having a dielectric constant greater than that of the cast dielectric slab(s); and pressing two conductors, each having first and second ends aligned with the first and second ends respectively of the dielectric composite slab, against each second dielectric composite material-coated cast dielectric composite slab to extrude the second dielectric composite material out from therebetween to completely fill the triple point region at each of the first and second ends of the transmission line with the second dielectric composite material.

18. The method of claim 17, wherein at least two dielectric composite slabs are cast and coated with the second dielectric composite material, and at least three conductors are arranged and pressed in alternating layered arrangement with the second dielectric composite material-coated cast dielectric composite slabs.

19. The method of claim 18, wherein the second dielectric composite material further comprises a higher concentration of high dielectric constant nanoparticles.

20. A method of fabricating a linear accelerator transmission line which extends towards a transverse acceleration axis from a first end to a second end for propagating an electrical wavefront therethrough to impress a pulsed gradient along the acceleration axis, comprising:

positioning at least one conductor in a mold cavity, said conductor having first and second ends which correspond to the first and second ends respectively of the transmission line;

filling the mold cavity with a dielectric composite comprising at least one organic polymer and at least one particle filler space having a dielectric constant greater than that of the organic polymer, to at least partially immerse the conductor in the composite; and curing the dielectric composite to integrally cast the dielectric composite with the conductor, and together forming the transmission line.

21. The method of claim 20, wherein at least two conductors are spaced from each other in the mold cavity to produce an alternating layered arrangement with the cast dielectric composite.

* * * * *